United States Patent [19]

Wagner et al.

[11] 4,236,855

[45] Dec. 2, 1980

[54] APPARATUS FOR AND METHOD OF SEQUENTIALLY TRANSPORTING, ACCUMULATING AND STACKING A PREDETERMINED NUMBER OF GROUPS OF INDIVIDUAL SIMILAR FLAT ARTICLES AND THEREAFTER DEPOSITING THE ENTIRE STACK ON A CONVEYOR

[75] Inventors: Roland W. Wagner; Clarence W. Heim, Jr., both of Cincinnati, Ohio

[73] Assignee: Warrick Equipment Corp., Cincinnati, Ohio

[21] Appl. No.: 940,477

[22] Filed: Sep. 8, 1978

[51] Int. Cl.[3] ..... B65G 57/03

[52] U.S. Cl. ..... 414/42; 53/157; 53/540; 414/45; 414/50; 414/69; 414/76; 414/99

[58] Field of Search ..... 414/42, 45, 50, 57, 414/69, 76, 77, 98, 99, 786, 907, 43, 47; 198/419, 425; 83/90, 91, 96; 53/156, 157, 540; 271/218

[56] References Cited

U.S. PATENT DOCUMENTS

| | | | |
|---|---|---|---|
| 2,805,755 | 9/1957 | Jones | 198/419 |
| 2,845,763 | 8/1958 | Wonsidler | 53/157 |
| 3,014,599 | 12/1961 | Lawrence et al. | 414/57 |
| 3,794,154 | 2/1974 | Holt | 198/425 X |
| 3,959,951 | 6/1976 | Payles | 414/42 X |
| 4,029,198 | 6/1977 | Lingl | 198/425 |
| 4,051,753 | 10/1977 | Everman et al. | 83/91 X |
| 4,137,604 | 2/1979 | Sandberg et al. | 53/157 X |

*Primary Examiner*—L. J. Paperner

*Attorney, Agent, or Firm*—Kinney & Schenk

[57] ABSTRACT

A plurality of flat, similar articles, such as, by way of example, individual slices of sausage which have been severed from an elongate substantially cylindrical sausage-stuffed casing, are randomly deposited onto a conveyor and then advanced in coplanar relationship to an accumulator station where predetermined numbers of articles are divided into individual groups, and each group of articles is advanced onto a carrier member for and which is unique to a particular group of articles, the carrier-member supported groups are advanced one-at-a-time to a stacking station where the articles of each succeeding group are deposited onto the articles of each preceding group until a predetermined number of groups of articles have been vertically stacked, after which the entire stack is released onto a conveyor for further processing.

19 Claims, 19 Drawing Figures

APPARATUS FOR AND METHOD OF SEQUENTIALLY TRANSPORTING, ACCUMULATING AND STACKING A PREDETERMINED NUMBER OF GROUPS OF INDIVIDUAL SIMILAR FLAT ARTICLES AND THEREAFTER DEPOSITING THE ENTIRE STACK ON A CONVEYOR

BACKGROUND OF THE INVENTION

1. Field of the Invention

The present invention is directed to means for and a method of bulk loading "groups" of flat articles, such as by way of example, individual hamburger portions or the like in a suitable receptacle wherein a predetermined number of groups of articles are sequentially accumulated and then deposited on individual carrier members for the articles of each group, after which the articles of each group are stacked and thereafter discharged in a stacked formation onto a conveyor on which they are supported prior to being housed within a receptacle introduced downwardly over a predetermined number of stacked articles.

2. Description of the Prior Art

Applicant is aware of bulk loading devices of the type in which a plurality of similar flat articles, such as by way of example, hamburger patties, are continuously advanced to a discharge station where they are directly deposited one-at-a-time into a receptacle in which a finite number of such frozen articles are accumulated for frozen storage and thereafter delivered to a restaurant, commissary, fast food outlet, or the like, however, applicant is unaware of any device or method as described in the foregoing Field of the Invention.

SUMMARY OF THE INVENTION

The bulk loader of the present invention continuously accumulates a plurality of similar sized preformed flat articles, such as by way of example, a meat patty or the like, wherein individual patties are advanced in end-to-end abutting relationship to a pair of movable gates the operation of which divides predetermined numbers of the foremost of said articles into individual "groups" which are deposited sequentially, that is, one at a time onto a moving carrier member which is common or unique to that particular group of articles deposited thereon. The carrier member may comprise a pair of similar sized sheets of parchment, wax paper, or the like, on which a predetermined number, such as by way of example, 6 individual articles of a "group" are deposited in two rows of three articles in each of said rows. The carrier member containing a "group" of articles is advanced to an elevator station where it is lowered whereby each successive carrier member containing similar "groups" of articles are deposited onto the upper surfaces of the articles of a preceding group until a predetermined number of "groups" each containing the same number of articles have been stacked one on top of another until a predetermined number, such as by way of example, 15 or 20 "groups" containing a total of from 90 to 120 individual articles is accumulated, whereupon the entire stack is deposited on an endless conveyor where the stack of "groups" of articles is advanced to a station at which an operator lowers a container, such as by way of example, a cardboard box, over and onto the stack of articles for thereby substantially filling said box with a predetermined number of "groups" of articles.

An object of the invention is to provide means for and a method of bulk loading a substantially continuous supply of flat and/or circular articles wherein each individual article has been severed from an elongate member having the same cross sectional shape or diameter as the individual articles but having a thickness of 15 to 40 times the thickness of the individual articles.

Other features and objects of the invention will be readily apparent from the accompanying drawings and description of the preferred embodiment.

DESCRIPTION OF THE PREFERRED EMBODIMENT

Figure 1:
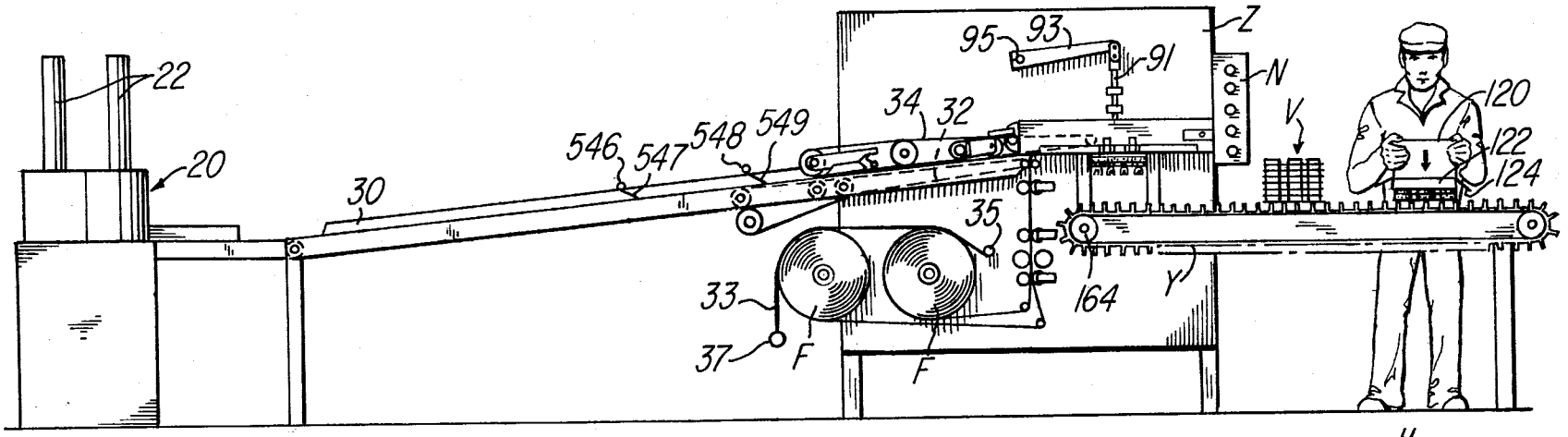
FIG. 1 is a side elevational view of an article stacking machine which embodies the teachings of the invention.
Figure 2:
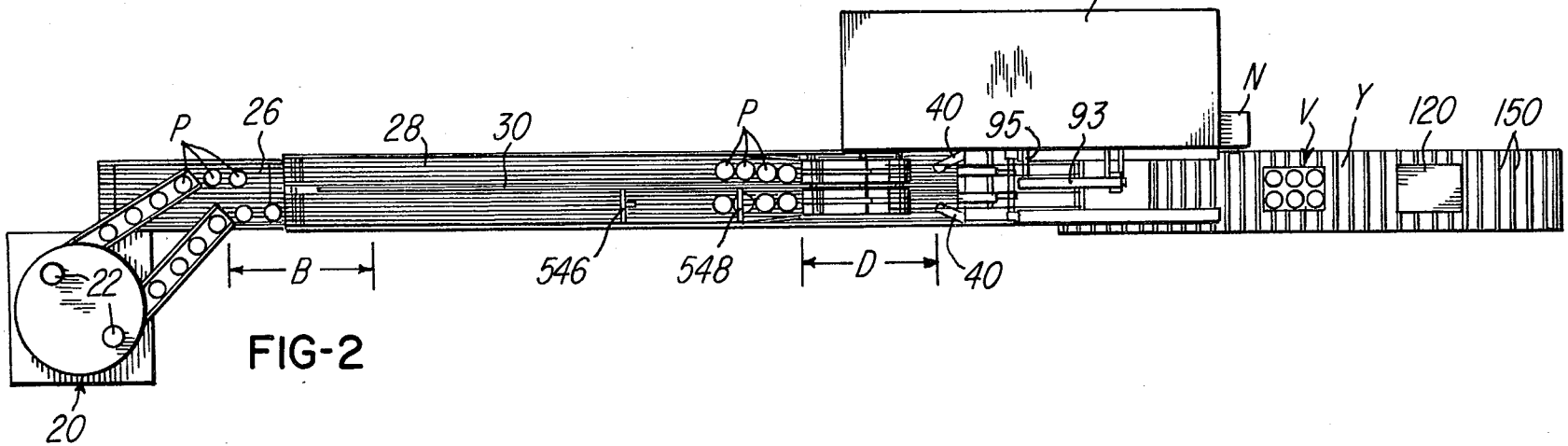
FIG. 2 is a top plan view of the stacking apparatus shown in FIG. 1.
Figure 4:
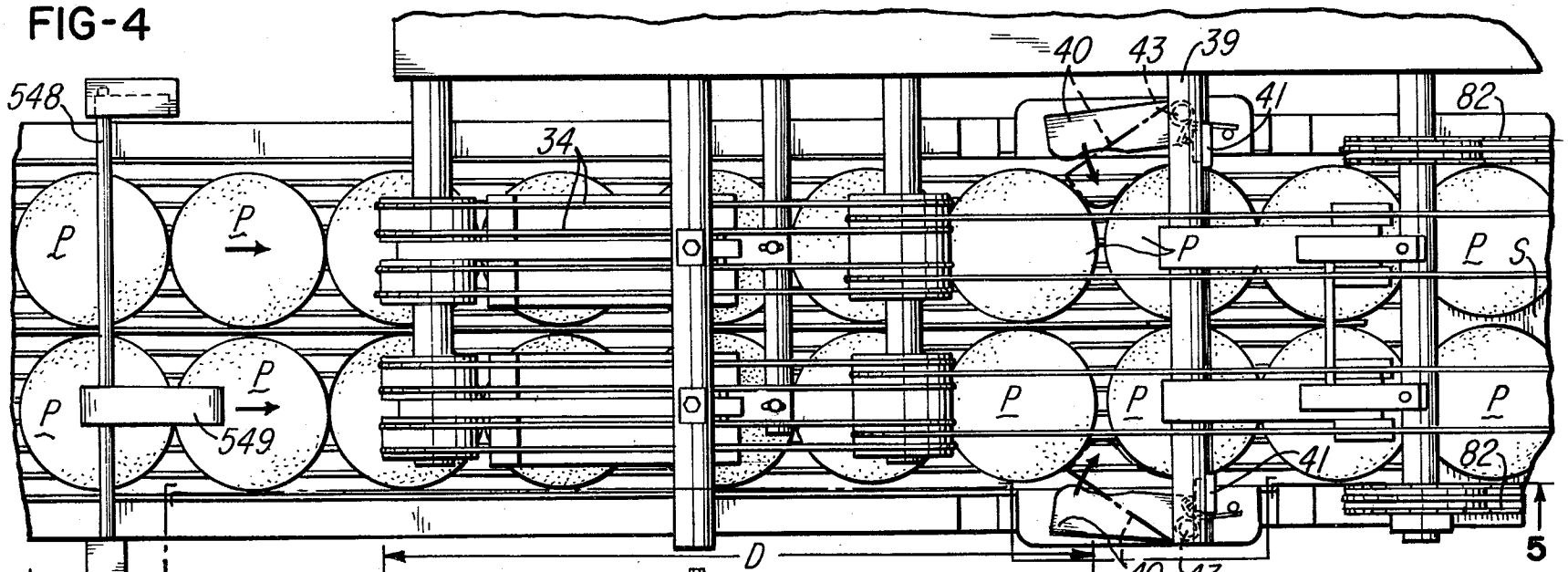
FIG. 4 is a fragmentary top plan view of the article accumulating and carrier member advancing stations of the machine drawn on a larger scale than FIGS. 1, 2, and 3.

With particular reference to FIG. 1 and 2, the numeral 20 designates generally a conventional slicer of the type which includes rotating blades which are adapted to continuously sever a plurality of slices from an elongate, substantially cylindrical, package or housing of a food product or the like, suitably confined within a casing or the like, and wherein a pair of such cylindrical members are adapted to be inserted endwise into each of a pair of upwardly extending guide-tubes 22, the lower ends of each of which are disposed above the rotating knives (not illustrated) whereby rotation of said knives automatically severs the product into similar-sized flat articles or patties P (note FIG. 2) which are deposited onto the upper surface of a conveyor 26 which advances the individual articles onto conveyor 28 and on opposite sides of an elongate center-divider 30 wherein the articles are advanced in two rows toward the accumulator station D, FIGS. 2 and 4.

The subject invention is neither concerned with nor directed to the specific structural details of the slicer mechanism 20–22, it being understood that such devices are commercially available for use in the meat packing industry.

Uniformly satisfactory results have been obtained in those instances in which the conveyor 26 and 28 comprises a plurality of laterally spaced, individual, elongate, narrow, endless belts.

The letters B indicate generally inspection stations along opposite sides of the adjacent portions of conveyors 26 and 28 along which operators are stationed to remove any non-uniform articles and to remedy any overlay conditions which may exist in the articles being advanced to the accumulator station D on opposite sides of divider 30. The individual articles P thus advanced to accumulator station D are arranged in end-to-end abutting relationship in two rows on opposite sides of divider 30 as best illustrated in FIG. 4.

That portion of the device indicated by the letter D, viz, the accumulator section, is defined by a conveyor 32, the linear speed of which is approximately 50% slower than the speed of conveyor belts 26 and 28, whereby the adjacent edges of the articles are disposed in abutting relationship. The foremost of the articles are then divided into individual "groups" each containing a predetermined number of articles.

Figure 5:
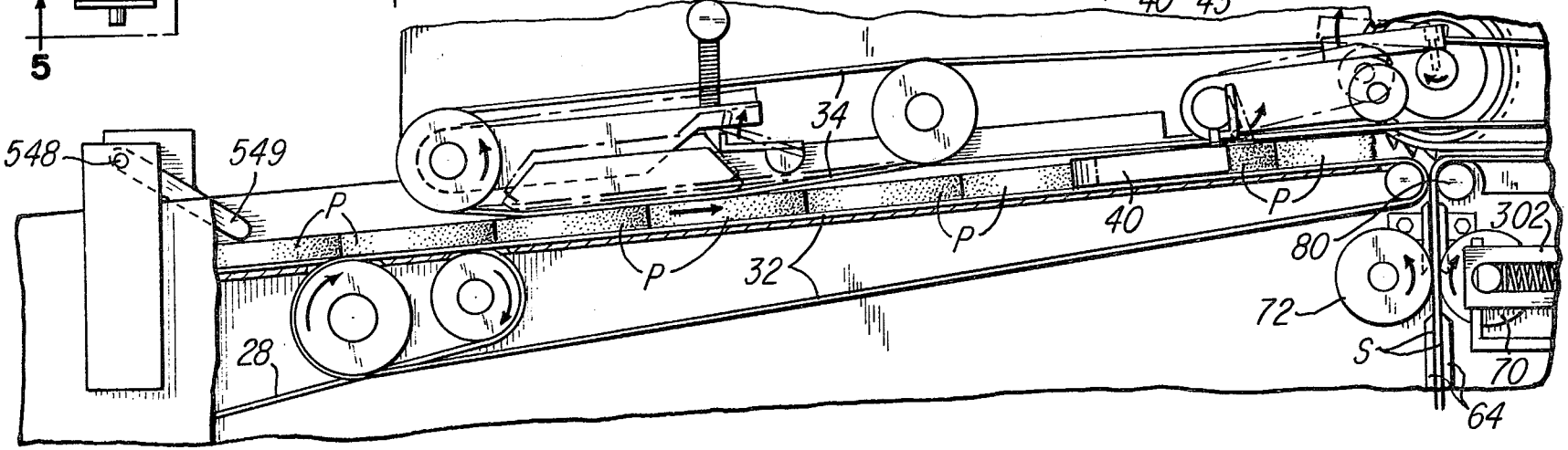
FIG. 5 is a fragmentary side elevational view, with parts broken away, taken substantially on line 5—5 of FIG. 4.

The collator section, as best illustrated in FIG. 4 and FIG. 5, includes collator belts 32 which extend under the articles and conveyor belts 34 which extend over and engage the upper surface of articles P, wherein the rate of travel of said belts is such as to match the speed at which a carrier member S for each group of articles is presented to and beneath the articles of each "group" as will be more fully hereinafter explained.

The overbelts 34 are arranged so that the "drive" applied to the articles on belts 32 can be selectively applied or released, in phase, with a pair of gates 40 which are pivotally mounted to and so timed as to momentarily interrupt the forward movement of the articles to the right until the articles of each preceding "group" have been deposited onto their individual carrier member on which they are advanced forwardly by an amount sufficient to provide a spacing between the next successive "group" of articles to be deposited onto another carrier member which is unique to the succeeding "group" of articles.

When gates 40 are in an open position the overbelt drive 34 is lowered to positively engage the upper surface of the articles whereupon they will move forward at the speed of the underbelts 32. The gates are maintained in an open position for a period of time sufficient to allow a predetermined number of articles to pass through, such as by way of example, 2 rows of 3 each, see FIG. 3.

After the third pair of articles, which collectively comprise a "group", has passed through the gates, they are actuated inwardly for providing abutments against which the forward edge of the foremost of the next group of articles abut, during which period of time the overbelt pressure on the articles is released thereby releasing them from driving contact with the underbelts 32 while permitting the articles to remain in a stationary condition. Gates 40 will remain closed for a sufficient period of time to establish a predetermined distance between each "group" of articles wherein the spacing is equal to the spacing of the carrier members on which the articles of a group are supported for advancement to the stacking station.

Figure 3:
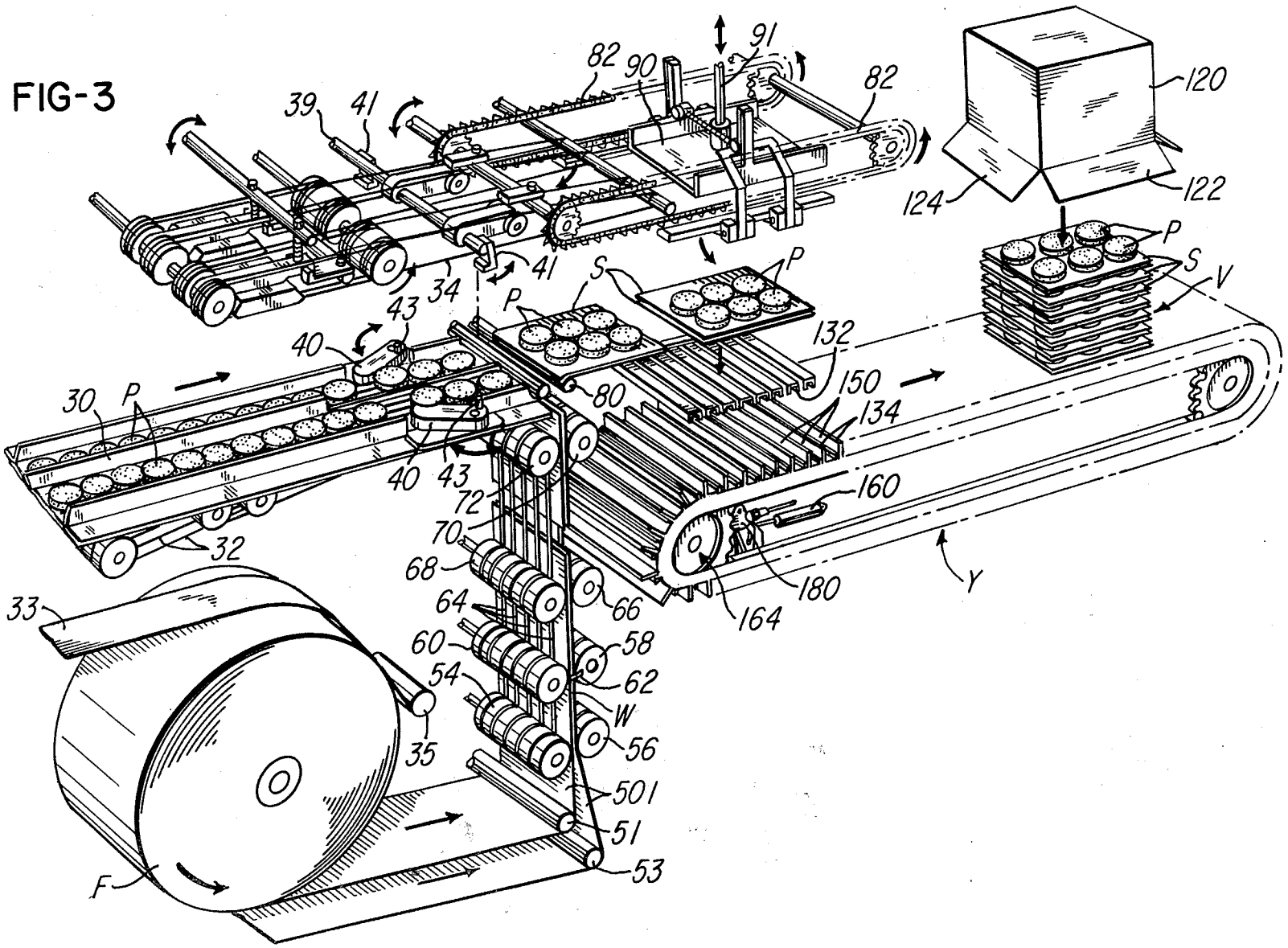
FIG. 3 is a fragmentary perspective exploded view of the article accumulating, carrier member advancing, group-stacking and stacked-group discharge apparatus of the machine.

The "group" of articles which has cleared, that is, passed through gates 40 continue to move forward, that is, to the right in FIGS. 1 and 2 onto their own individual carrier member S of FIG. 3.

Figures 6, 7, 8:
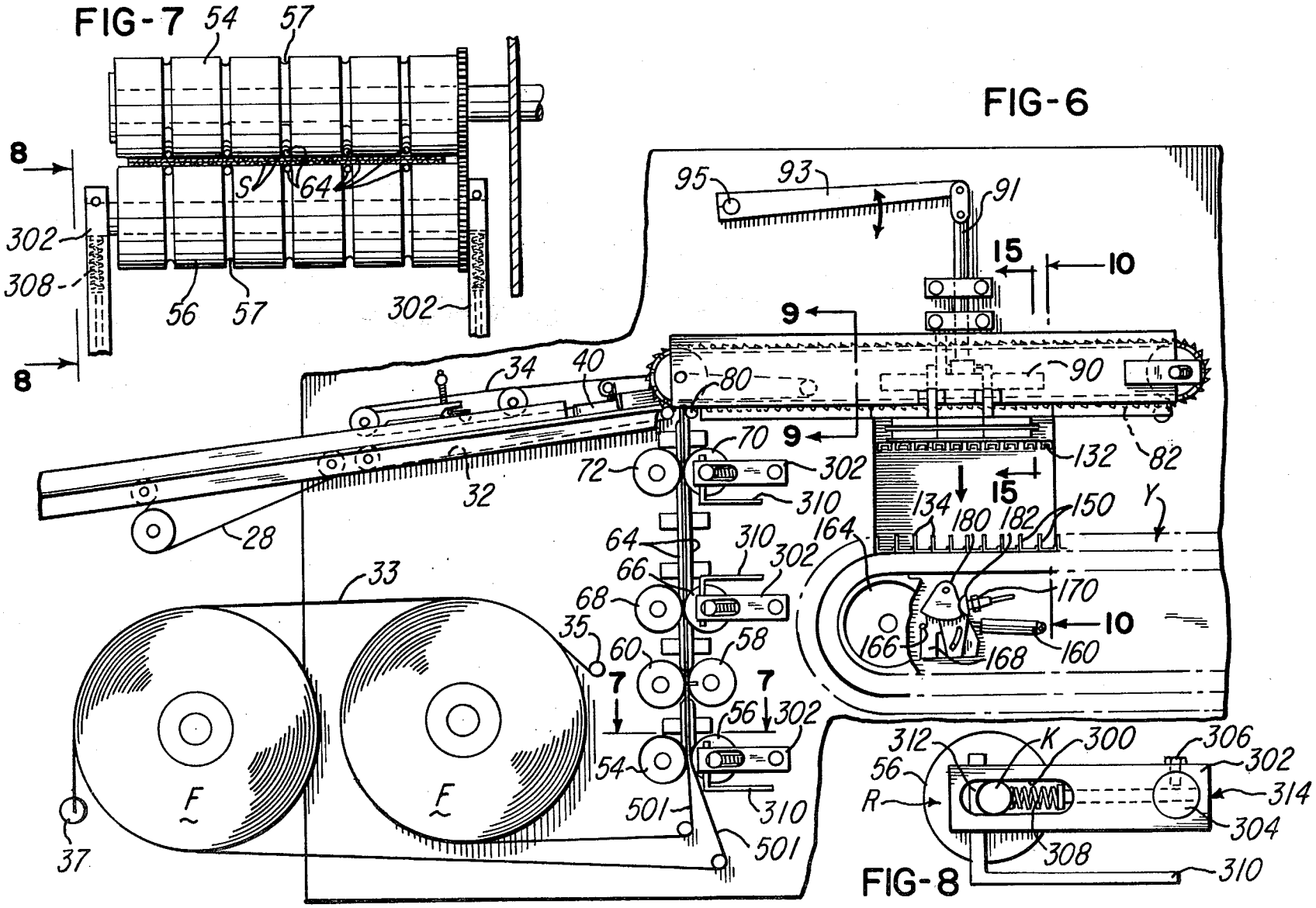
FIG. 6 is a fragmentary side elevational view of those portions of the machine at the article accumulating, carrier member advancing, group-stacking and stacked-group discharge stations drawn on a larger scale than FIG. 1.
FIG. 7 is an enlarged fragmentary elevational view of the carrier member drive rollers, taken along line 7—7 of FIG. 6.
FIG. 8 is a detailed view of the tensioning means for the carrier member drive rollers shown as at 8—8 of FIG. 7.

Uniformly satisfactory results have been obtained in those instances in which the carrier member S comprises or is defined by a sheet or sheets of interleaf material denoted generally by the numeral 501 of waxed paper, parchment or the like, suitably stored on rollers F such that the continuous web of material from each roll is caused to pass between and be subjected to adjustable alignment rollers, the two rolls being aligned with one another to form in effect a two-ply composite sheet W as clearly illustrated in FIG. 3. Both sheets of the material are caused to pass under guide rods 51 and 53, thence upwardly between driven rollers 54–56, which literally pull the webs of paper from their respective rolls F against the counterforce applied by a strap-like member 33 which, as illustrated in FIGS. 3 and 8, overlies the rolls. One end of the strap is anchored as at 35 and the other end is provided with a weight 37. The web from rollers 54–56 is directed to and between shear rollers 58–60 which are driven at the same speed as the first driven rollers 54–56. One of said shear rollers (58) includes a serrated blade 62 which in the preferred embodiment has several slots in the face thereof whereby to effectively clear and prevent contact with the guide rods 64, (see FIGS. 3 and 7) which project upwardly between the various rolls between which the composite web of material passes upwardly, it being noted that the rolls are also provided with circumferential grooves 57 to receive and accommodate said guide rods. From the foregoing it will be understood that the blade 62 shears or cuts the composite web W into individual carrier members S except for several narrow tabs which define connectors between the successive tab-interconnected carrier members. The partially severed composite web is then advanced between rollers 66 and 68 which are driven at the same rotational speed as driven rollers 54–56 from which they differ in that they can be overriden by means of a one-way clutch in the drive train.

The now partially severed composite web W is then directed between rollers 70–72 which are driven at the speed at which the "groups" of articles are advanced from the accumulator station. The speed of advancement of the rollers 70–72 is about 25% faster than the speed of rotation of rolls 66–68.

When rollers 70–72 engage the leading edge of the double ply thickness of web material W, the sudden increase in speed will sever the connector tabs between the trailing edges of the sheets of the uppermost carrier member S from the leading edge of the next subsequent carrier member S along the transverse shear line imparted by blade 62.

The having-been-defined 2-ply carrier members S are advanced upwardly and forwardly over roller 80 (FIG. 5) into a horizontal plane and simultaneously therewith the "group" of six collated articles immediately to the right of the gates 40 are advanced onto the individual carrier member S.

The outermost side edges of the carrier member are engaged by a pair of laterally spaced spike chains 82, the spikes 84 of which pierce through the side edges of the carrier member S and project into an elongated groove or track 86 whereby the spike chains will advance the article or patty-laden carrier member S to the right toward a vertically reciprocable ram 90 and in vertical alignment with one or the other of the two support platforms 50 and 50' of the elevator carriage mechanism of FIGS. 11–14. The frequency of the stroke of the ram 90 is synchronized with the carrier member feed such that the ram will be in a fully elevated position as each patty-laden carrier member is advanced to the right to a position immediately beneath the ram.

Figure 15:
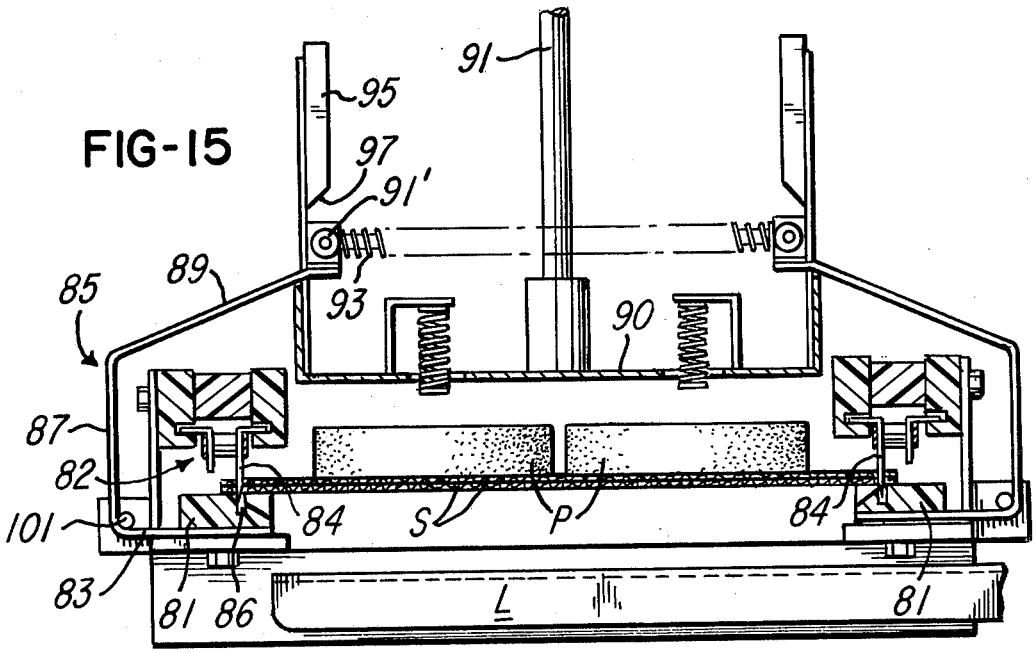
FIG. 15 is a fragmentary sectional view of the ram and carrier release mechanism, taken along line 15—15 of FIG. 6, and drawn on a somewhat larger scale.

In FIG. 15 the relationship of an article-laden carrier member S to the ram in its fully elevated position and the manner in which the spikes 84 of chain 82 support the carrier member is illustrated.

Figure 16:
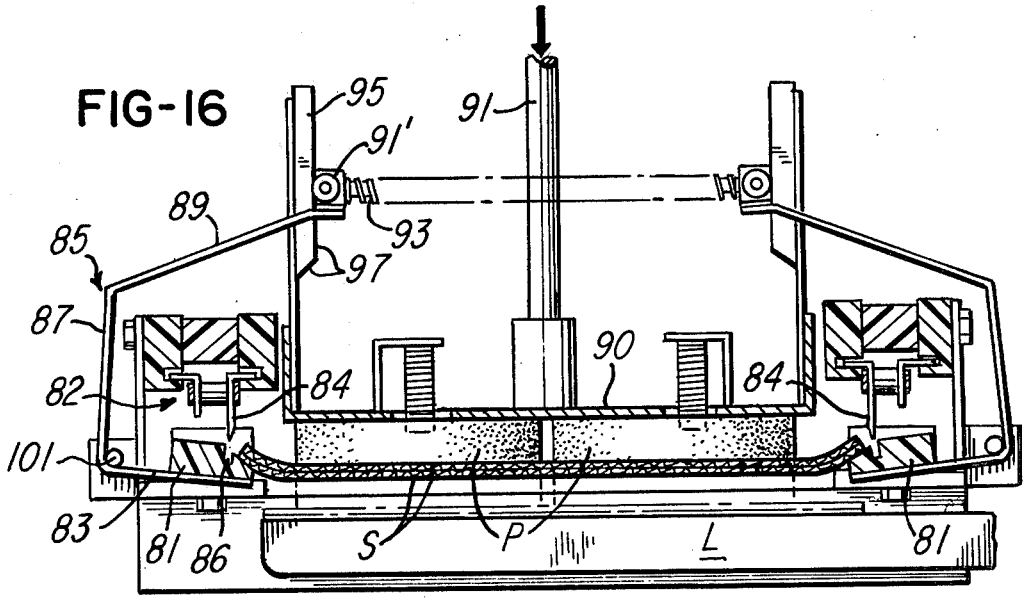
FIG. 16 is a view similar to FIG. 15 showing the ram and carrier release mechanism in a different position.

As clearly illustrated in FIG. 16, lowering of the ram causes the lower surface thereof to contact the upper surface of the "group" of articles on the carrier member S, and simultaneously therewith the groove or track 86 is disengaged from the spikes 84 thereby permitting the side edges of the carrier member to become disengaged from the spikes of chain 82.

The elongate members 81 in which the grooves or tracks 86 are located are secured to and carried by the lower leg 83 of a pair of substantially U-shaped carriers 85, each of which include a side leg 87 and an upwardly and inwardly inclined upper leg 89 which terminates in a cam follower 91, it being noted that suitable means, such as a spring 93, are utilized to normally and yieldably force the cam followers apart to the positions illustrated in FIG. 15 wherein the elongate members 81 are in a substantially horizontal position and with the spikes 84 projecting into the grooves or tracks 86.

Cams 95 having camming surfaces 97 are suitably mounted for movement with ram 90, and when the ram is lowered from the elevated position of FIG. 15 to the lowered position of FIG. 16 the cams force the cam followers 91 toward one another thereby causing the carriers 85 to tilt about fixed members 101 for effecting the hereinabove described disengagement of the spike 84 from the channels or tracks 86.

Directly below the ram 90, as best illustrated in FIGS. 10–14, a support platform 50 of the elevator carriage mechanism is positioned to sequentially receive each succeeding article-laden carrier member S since the down stroke of the ram will deposit the first of the article-laden carrier members on the upper surface of the vertically reciprocable support platform. Each time the ram is lowered another article-laden carrier member is deposited onto the upper surface of the articles on the preceding carrier member until a predetermined number of "groups" of articles have been stacked on the support platform.

The support or elevator platforms 50 and 50' are so constructed and arranged as to be initially presented in a fully elevated position L (as illustrated in the solid lines of FIGS. 10 and 11) relative to the horizontal plane in which the article-laden carrier members S are advanced to and beneath the ram. Each time a subsequent article-laden carrier member is deposited, the elevator platform will be lowered in a step-by-step manner until a predetermined or total number of "groups" of articles have been vertically stacked, at which time the elevator platform will have been depressed to that lowered position M as determined by the "count" of the predetermined number of "groups" of articles deposited on the platform, after which the platform is then automatically lowered to its fully lowered position indicated by the letter J.

Each down stroke of the ram forces the extended platform downwardly to a lower position at which it is automatically retained such that the top surface of the articles on the uppermost of the carrier members S on the platform will be low enough to clear the next successive article-laden carrier member S as it is advanced under the ram when elevated to the top of its stroke to accept the next successive "group" of articles.

Figures 9, 10:
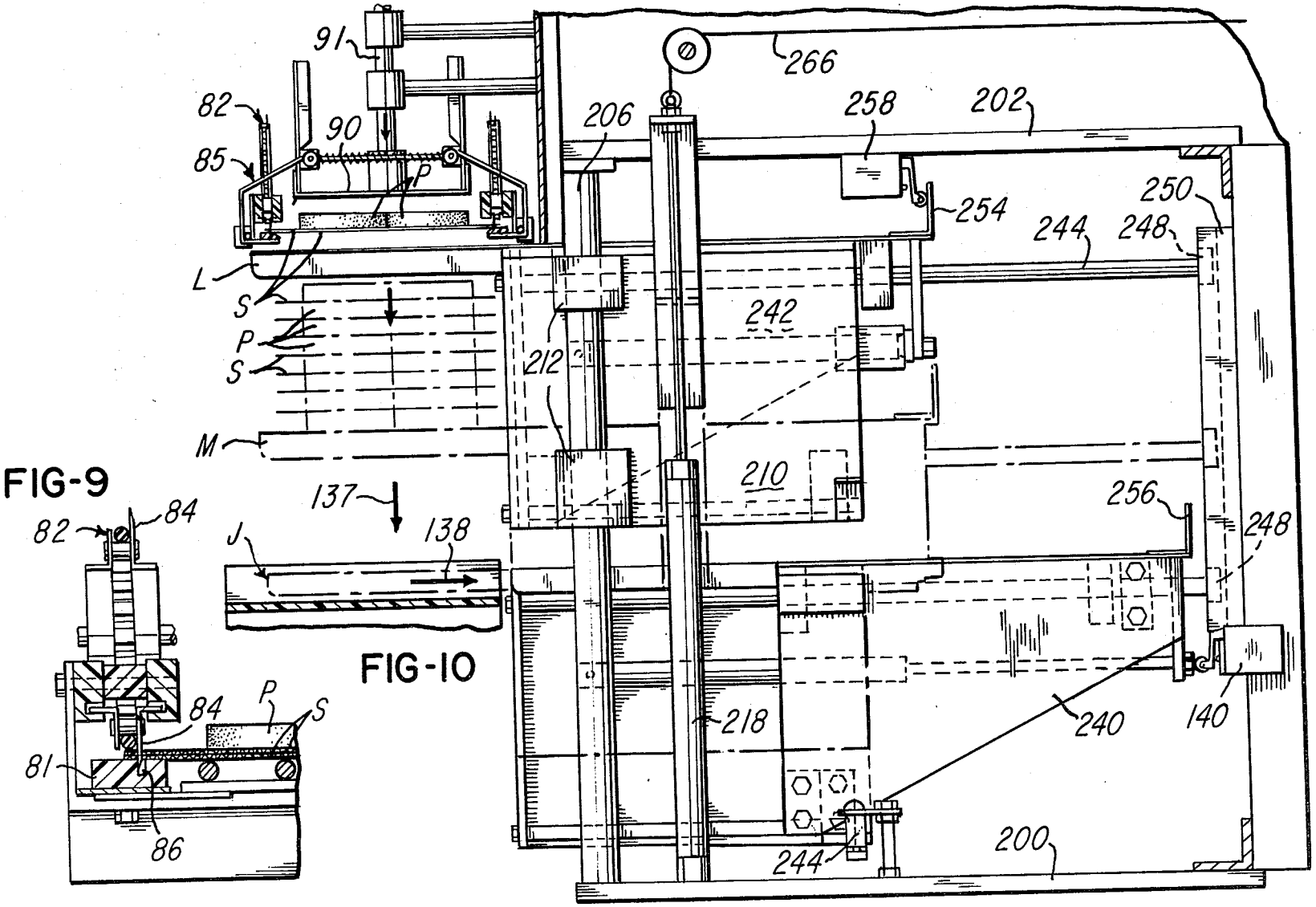
FIG. 9 is a fragmentary sectional view taken substantially along 9—9 of FIG. 6. elevator and ram mechanism, taken along the line 10—10 of FIG. 6.
Figure 13:
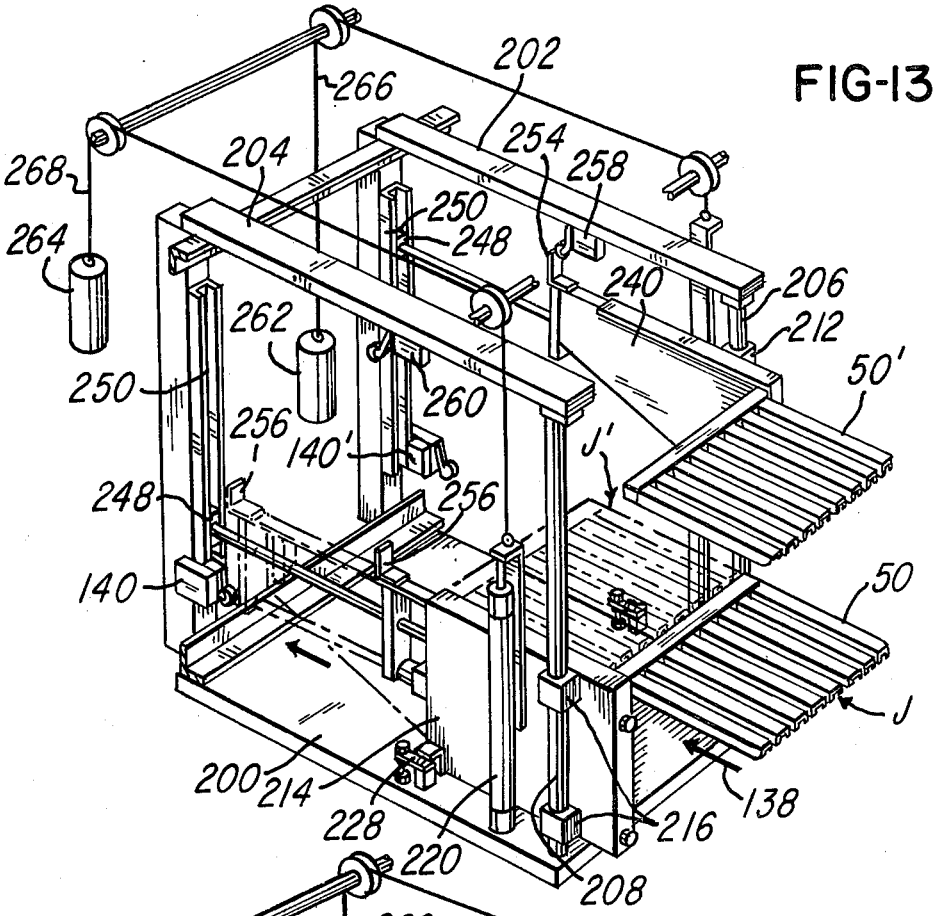
FIG. 13 is a perspective view taken of the other side of the device illustrated in FIG. 11 illustrating the relationship of the parts when the extended support platform deposits the group of articles onto the output conveyor and illustrating the other support platform in a now fully advanced article-receptive position.
Figure 19:
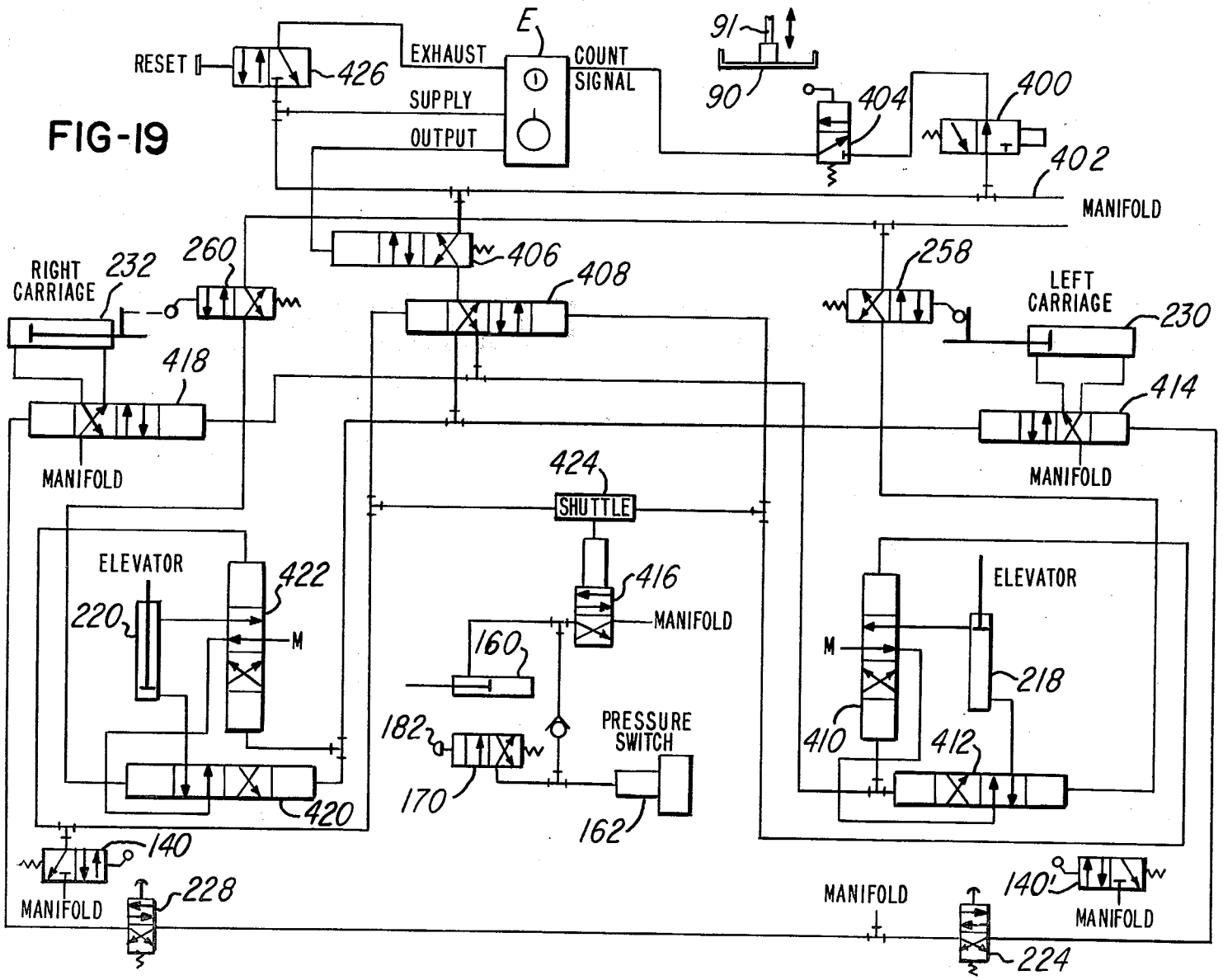
FIG. 19 is a schematic view of the pneumatic circuitry of the sequence device.

After a predetermined number of "groups" of articles have been thus stacked upon an elevator platform, and it has reached a lower position M, as determined by a pre-set counter E, FIG. 19, it is rapidly driven downwardly to its fully lowered position J where it is then rapidly retracted, to the right, as in FIGS. 10 and 13, for depositing the entire stack V of articles onto the output conveyor Y, the function of which is to advance the stack of articles from beneath the zone of vertical travel of the elevator carriage platform to a location where, by way of example, an inverted carton 120 may be lowered onto the stack V for thereby housing same (FIG. 1). The now-filled carton is suitably turned over for enabling the side and end flaps 122 and 124, respectively, to be actuated to house the articles within the carton which is then ready to be refrigerated for storage or delivery to a purchaser who will open the closed and sealed carton to gain access to the "groups" of articles therein.

Figure 11:
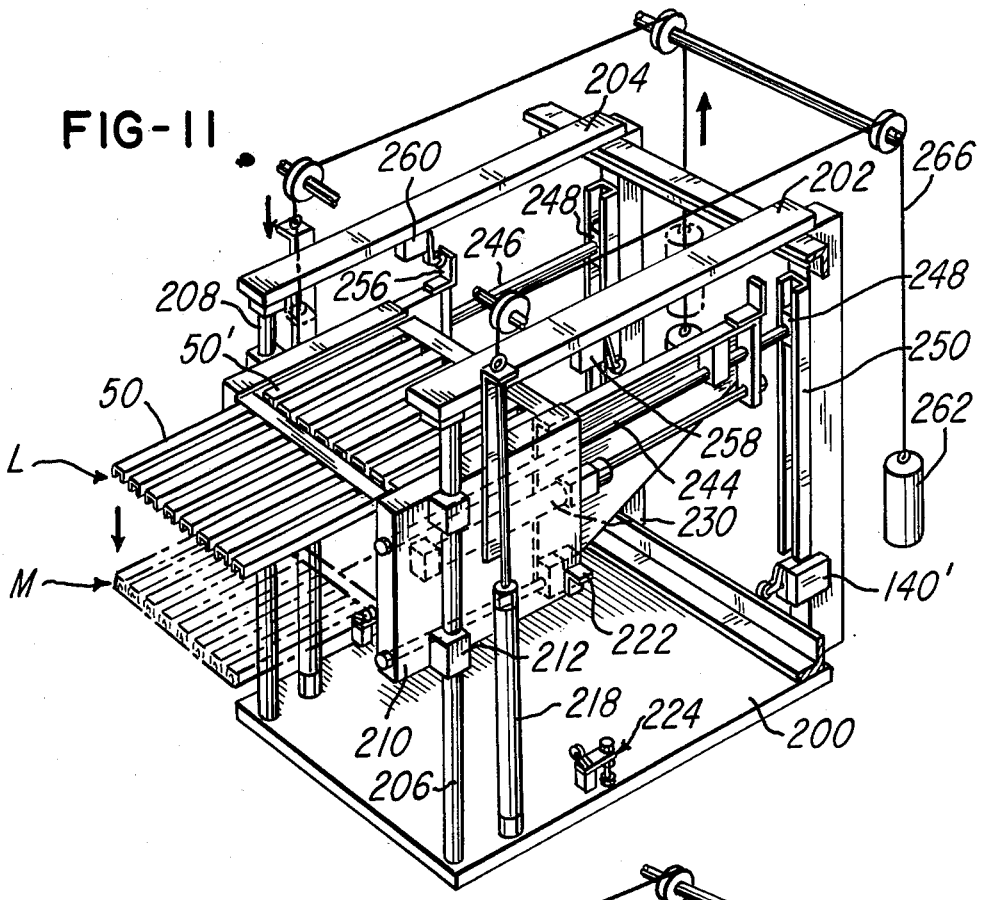
FIG. 11 is a perspective view of the elevator carriage mechanism illustrating the relationship of the parts with each of the carrier-receptive support platforms in their fully elevated positions with one of said support platforms in advanced position to receive individual groups of articles as supported on their individual carrier sheets, and with the other support platform in a retracted position.
Figure 12:
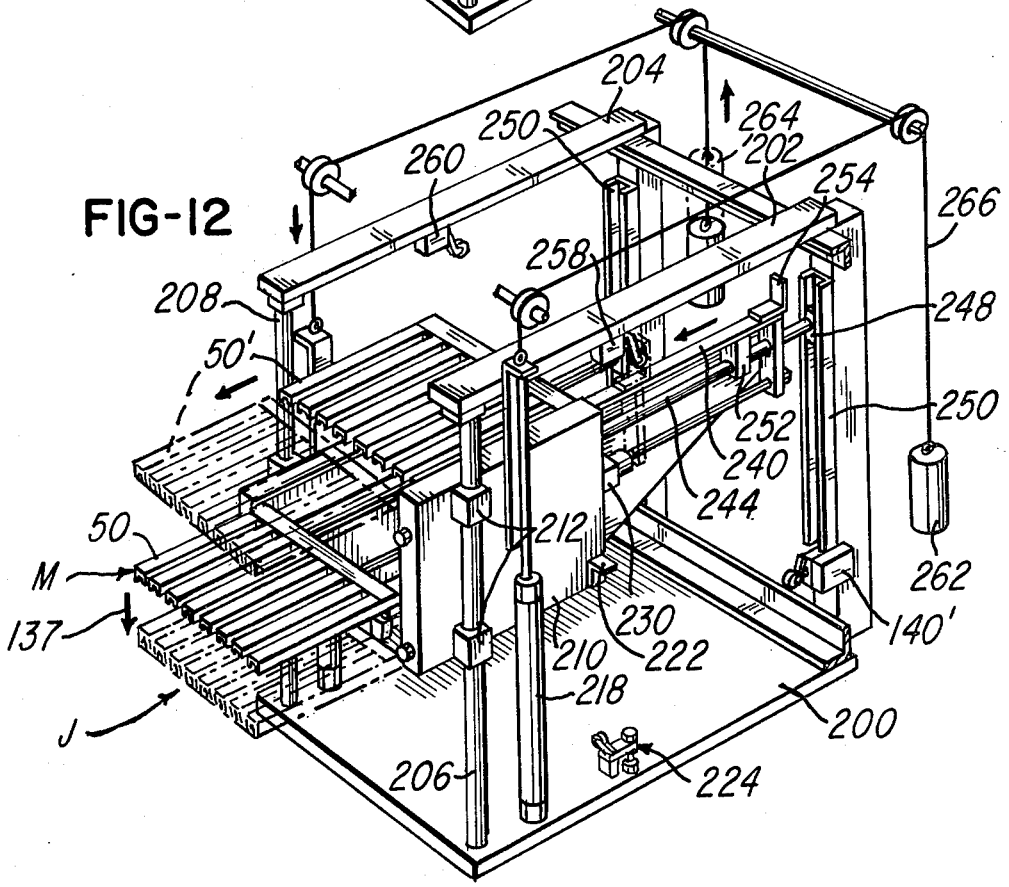
FIG. 12 is a perspective view similar to FIG. 11 illustrating the relationship of the parts when the extended support platform is at the end of a count, which determines the total number of groups of articles stacked thereon.
Figure 14:
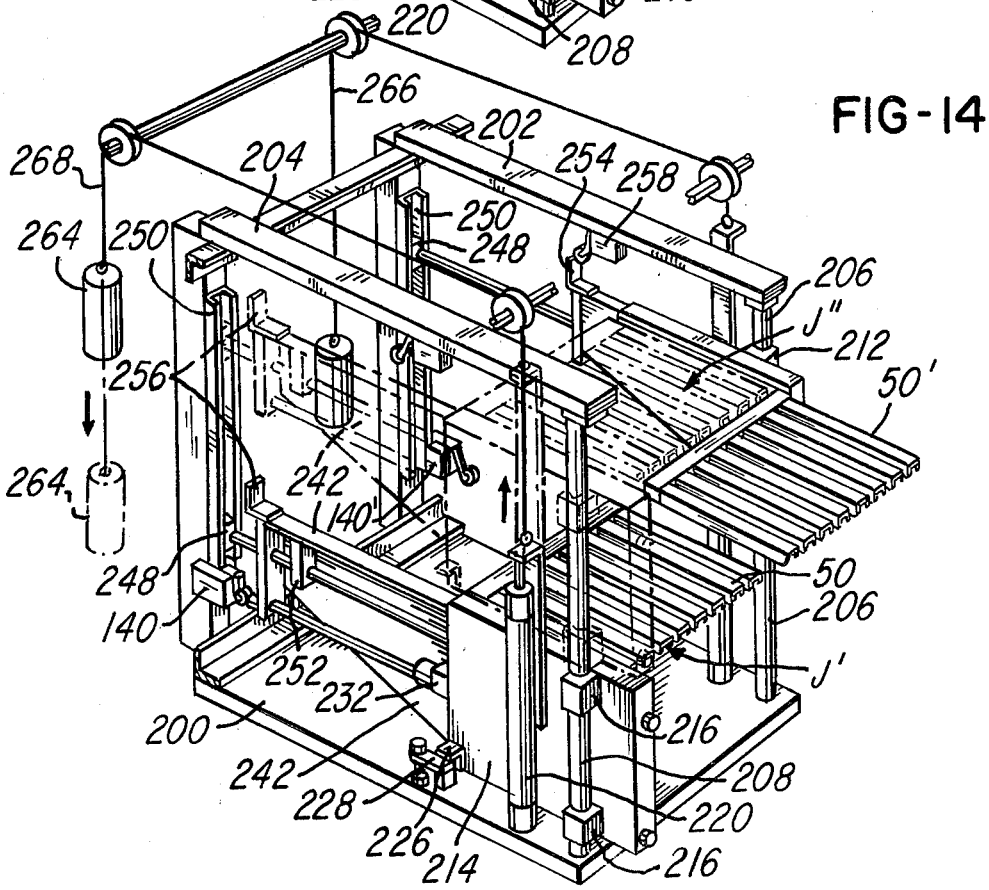
FIG. 14 is a view similar to FIG. 13 illustrating the relationship of the parts when the lowermost support member has been withdrawn prior to being elevated into the plane of the fully extended support platform.

In the preferred embodiment of the invention the elevator carriage mechanism comprises a right operative section of FIGS. 11 and 12 and a left operative section of FIGS. 13 and 14 which are identical in structure and motion, both of said sections being suitably counterbalanced, and wherein platform carriage 50 comprises part of the left operative section, and platform 50' part of the right operative section.

When the left section of the carriage elevator is up with platform 50 extended outwardly as at L to accept a sequence of article-laden carrier members, platform 50' of the right section thereof is located in a fully elevated but inoperative position, having been elevated from its lowermost retracted position J' to its fully raised, but inoperative position J'', whereby to be poised for rapid advance movement to the left as the ram 90 is elevated after depositing the last of the predetermined number of "groups" of articles in stacked relationship on the other platform 50, said advance of platform 50' occurring simultaneously with the retraction of platform 50, whereby to be in place to receive the first of article-laden carrier members S of the next "group" of articles to be stacked as lowered by the next downward movement of the ram.

Figure 17:
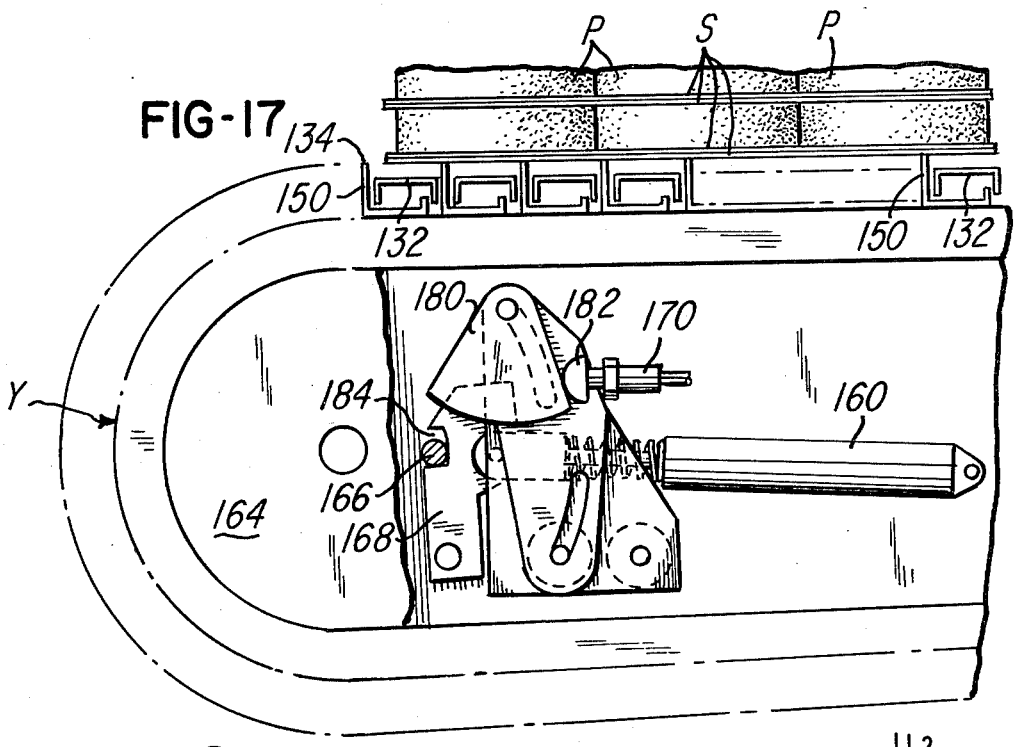
FIG. 17 is an enlarged fragmentary side elevation, with parts broken away, illustrating the indexing means for the output conveyor.

The relationship of the upstanding slats 150 of conveyor Y is such that the slats will project upwardly between adjacent inverted U-shaped channels 132 of platforms 50 and/or 50' whereby the upper surfaces 134 of slats 150 project above the upper surfaces of channels 132 upon which surfaces the carrier member S of the lowermost of the "groups" of stacked articles is deposited, note FIG. 17. The aforesaid relationship permits the fully loaded elevator platform to actually deposit its load of stacked "groups" of articles onto the slats of conveyor Y before the elevator carriage and its associated platform reaches the bottom of its downward travel J before it is withdrawn and shifted to the right as indicated by the headed arrow 138 of FIG. 10.

The output conveyor Y is operated intermittently each time an elevator carriage platform 50—50' is in a fully lowered and retracted position J' where it strikes a limit valve 140 or 140' which directs the elevator carriage to a fully elevated but retracted position J''. Actuation of the limit valves 140 or 140' also actuates cylinder 160 (FIGS. 3, 6 and 19) through which a pressure switch 162 is closed for applying power to a conveyor motor, not illustrated, to move conveyor Y and the stack of articles thereon forwardly to position H, FIG. 1.

The amount of travel of conveyor Y is precisely determined by one complete revolution of the conveyor drive sprocket 164 which carries a protruding pin 166 which is captured by or in notch 184 of the latch 168 just after the pin has actuated valve 170 to stop the motor, as hereinafter explained.

If and when unlatched, the sprocket 164 turns through one complete revolution at which time it is relatched. In this manner the slats 150 of conveyor Y are disposed in precise alignment with the spaces between the inverted U-shaped channels 132 of the elevator platforms.

Just prior to reaching the latch 168, pin 166 engages and deflects the pivotally mounted cam 180 which activates the projecting, headed plunger 182 of valve 170 to depressurize the pressure switch and disconnect power to the motor. As the unenergized motor continues to coast, pin 166 is again driven into the pin-receptive notch 184 of latch 168.

The letter Z designates generally a housing in which the various pneumatic and electrical controls are located along with the motors and driving mechanisms for the various conveyors, gates 40, ram 90, carrier member drives, and the like.

As best illustrated in FIG. 3, shaft 39 is rotated back and forth for rocking levers 41 into and out of engagement with upstanding pins 43 of gates 40 which are pivotally mounted for movement into and out of interferring relationship with articles P for dividing them into individual groups.

Platen 90 is intermittently raised and lowered to the positions of FIGS. 15 and 16 by member 91' which is secured to and carried by lever 93 which is in turn secured to and carried by a shaft 95 which is rotated back and forth in timed relationship with the back and forth motion of shaft 39 whereby the opening and closing motion of the gates are synchronized with the up and down motion of the ram. The present invention is neither directed to nor concerned with the particular mechanism or relationship of parts by which the said synchronous motions are attained since any one of a plurality of well known mechanisms can be utilized.

In FIG. 8 the letter R designates collectively any of rolls 56, 66, and/or 70 of FIG. 6, and the letter K designates an axle which is adapted to be securely through releasably locked in endwise axial adjustment within an elongate slot 300 of a bracket 302 which is suitably anchored in adjusted position to a transverse rod 304 by a clamp screw 306. A spring 308 urges axle K toward the left, that is, toward the driven mating roll 54, 68, or 72, respectively, of rolls 56, 66, and 70. Movement of lever 310 about its vertical axis produces a camming action at 312 on axle K forcing the axle to the right against the counterforce of spring 308, thereby selectively shifting roll R from its corresponding roll 54, 68, or 72. An elongate screw 314 terminates in a pressure plate 316 which bears against the outer end of spring 308 for enabling the tension thereof to be selectively and conveniently varied.

ELEVATOR CARRIAGE MECHANISM

In FIG. 11 the platform 50 is illustrated at L in solid lines at its fully raised, fully extended position, and at M at the lowered position as determined by counter E which initiates a signal to drive it down to its fully lowered and extended position J. When it reaches position J it deposits the stack of articles on the output conveyor. When the stack is deposited, the left elevator mechanism and its platform 50 moves back into the machine, and the same signal that drives the aforesaid left mechanism and its platform to the J position also signals the right elevator mechanism and its platform 50' to extend platform 50' out to receive the next succeeding layer of articles and the ram then starts driving that stack of products onto platform 50'. When the left elevator mechanism is retracted it strikes limit valve 140 which ports pressure to the elevator cylinder and drives the left elevator mechanism to the up and in position to locate platform 50 at J'' where it remains in wait for the signal that will drive the right elevator mechanism and its platform 50' to repeat the aforesaid motions of the left elevator mechanism.

With particular reference now to FIGS. 11–14 it will be noted that the aforesaid elevator mechanisms are contained within a framework which includes a bottom wall 200 and a pair of laterally spaced top members 202 and 204. A pair of laterally spaced guide rods 206 and 208 are disposed in spanning relationship between bottom wall 200 and the top members 202 and 204. An elevator 210 is mounted for movement along guide rods 206 on bearings 212, and an elevator 214 is mounted for movement along guide rod 208 on bearings 216 whereby each of said elevators is mounted for movement between fully elevated and fully lowered positions by means of cylinders 218 and 220 respectively.

A bracket 222 on elevator 210 is adapted to engage and actuate valve 224 as elevator 210 reaches its fully lowered position, that is when platform 50' reaches its lowermost position J. By the same token, bracket 226 of elevator 214 engages valve 228 as illustrated in FIGS. 13 and 14.

Actuation of valves 224 and 228 as aforesaid will actuate cylinders 230 and 232 respectively for retracting carrier member support platforms 50 or 50' to the fully lowered retracted position J', it being noted that when disposed in a fully retracted position, elevators 210 and 214 will engage and actuate valves 140 and 140' which pressurizes cylinders 220 and 218 driving elevators 210 and 214 from their fully lowered position J' to their fully elevated position J".

Each of the support platforms 50 and 50' are caused to move along or in a substantially rectangular path, and since support platform 50 is secured to and controlled by the left elevator mechanism and support platform 50' by the right elevator mechanism, the aforesaid rectangular motions occur in synchronization wherein movements of the support platforms are entirely free of interference, it being understood that whenever a platform is being elevated while in a fully retracted position to a fully elevated position, the other support platform is in a fully extended position.

The numerals 240 and 242 denote the carriages of the left and right elevator mechanisms respectively, said carriages being adapted for lateral motion between fully extended and retracted positions J and J' incident to movement of the carriage along guide rods 244 and 246. The outer ends of guide rods 244 and 246 are attached to elevators 210 and 124 whereas the rear ends of said rods terminate in a shoe 248 which rides within a vertical channel 250 which extends between and is secured relative to bottom wall 200 and the laterally spaced top members 202 and 204 thereby maintaining guide rods 244 and 246 in desired parallel relationship incident to movement to elevators 210 and 214 between their raised and lowered positions.

Carriages 240 and 242 are secured relative to their respective guide rods 244 and 246 by suitable bearings 252.

When carriages 240 and/or 242 are elevated incident to upward movement of elevators 210 and/or 214, brackets 254 and 256 are adapted to engage valving members 258 and 260 respectively as their respective carriages 240 and 242 are extended incident to the introduction of fluid media into cylinders 230 and 232.

Actuation of valves 258 and 260 results in the unloading of pressure on cylinders 218 and 220, and but for the presence of counterweights 262 and 264 which are secured to each of the elevator assemblies by means of flexible cables 266 and 268, those assemblies would drop or gravitate to the bottom of their vertical travel.

The counterweights provide a "no-load" effect to the respective right and left elevator mechanisms whereby the support platforms of each of said mechanisms when in a fully elevated advanced position will be lowered in a step-by-step manner incident to the application of each successive group of carrier member supported groups of articles onto a support platform incident to the lowering of ram 90. In other words, the fully elevated and extended platform will be lowered in a step-by-step manner until such time as a predetermined number of "groups" of articles have been deposited thereon at which time the platform will have assumed position M, and simultaneously therewith counter E will be activated whereby to introduce pressure media into cylinders 218 or 220 for thereby positively driving the platform from position M to a fully lowered position J for depositing the articles stacked thereon onto the upper surface 150 of the output conveyor Y. The same signal initiated by counter E which drives the article "loaded" platform from position M to position J, simultaneously advances the other support platform from its fully elevated but retracted position J" to a fully advanced or extended elevated position L in a position to receive the next group of articles of the next succeeding cycle.

PNEUMATIC CONTROLS FOR ELEVATOR CARRIAGE MECHANISMS

With reference to FIG. 19 it will be noted that pressurized air from manifold line 402 is supplied through solenoid valve 400 to valve 404 which is actuated each time ram 90 is lowered for depositing a carrier-member-supported group of articles onto one or the other of the support platforms 50—50'. Each time the ram actuates valve 404 a pulse of pressurized air is supplied to counter E. Whenever the counter has thus received the number of impulses necessary to stack a predetermined number of individual groups of articles onto a support platform, during which time the platform is lowered in a step-by-step manner from a fully elevated position L to the partially lowered position M, counter E sends an output signal to pilot valve 406 which is shifted or actuated to direct air pressure to shift valve 408. Valve 408 is adapted to selectively shift the pulse to either the right or left elevator carriage mechanisms.

When air passes through valve 408 it ports valve 410 and valve 412 into a position to where the cylinder 218 drives the elevator 210 to a down position. When the elevator operated by cylinder 218 reaches the down position J it actuates valve 224. Valve 224 applies pressure to the inport on valve 414 of the left carriage. Valve 414 shifts, applying pressure to move the left carriage cylinder 230 to the in-position, J', viz down-and-in as indicated by the headed arrows 137 and 138 of FIG. 10.

When the carriage reaches the down-in position it actuates valve 140' which shifts port pressure to valve 410 which shifts and ports pressure to elevator cylinder 218 driving it to the up-position J", viz up-and-in. The valve 140' also applies pressure to shift valve 408 at the same time it applies pressure to the output conveyor valve 416 actuating latch cylinder 160 and pressure switch 162 to energize the output conveyor motor. Valve 408 which was shifted, changes the next incoming output pulse of the counter E to operate the right carriage system. The sprocket wheel 164 of the output conveyor motor runs until pin 166 strikes cam 180 engaging plunger 182 which actuates valve 170. When valve 170 is energized the pressure built up against the pressure switch 162 which controls the output motor is exhausted, the switch opens and the output conveyor motor coasts to a stop.

The output pressure of valve 408 which operated valve 410 and valve 412 to drive the left elevator down, is also directed to valve 418 which controls the right carriage in-out movement through cylinder 232. When valve 418 is ported through the count output E the right carriage which is in the up-in position is directed into the up-out position so that it can pick up the next layer of articles which the ram will deposit on it. When the right carriage is moved out by cylinder 232 it strikes valve 260 which allows pressure to be applied to the pilot of valve 420. Valve 420 shifts, opening the up-pressure side of cylinder 220 to atmosphere. The opposite, or down-side, of cylinder 220 is already at atmosphere through valve 422.

This allows cylinder 220 to be moved up and down freely with no restriction or entrapment of the air either on the upside of the piston or on the lower side of the piston so that when the ram keeps applying successive groups of articles onto the support platform 50 or 50' their respective elevators will move down smoothly and not be stopped by entrapped air in the actuating cylinders 218 or 220. The output pressure from valve 140 shifts valve 408 so that the next incoming signal from the counter E will operate the opposite side of the elevator mechanism.

In FIG. 19 it should be understood that the word MANIFOLD and the letter M designate a common source of pressurized air from a suitable source, not illustrated, such as a tank or the like.

The numeral 424 denotes a shuttle valve the function of which is to actuate valve 416 which controls the output conveyor Y from a signal from valves 140 or 140' of either the right or the left elevator carriage mechanisms.

The numeral 426 designates a reset valve the function of which is to reset the counter E to zero any time before the predetermined final count (at elevation M) has been attained. Actuation of valve 426 sends a signal which has the same effect as the normal output signal of counter E for actuating the elevator carriage mechanisms.

ELECTRICAL CONTROLS

Figure 18:
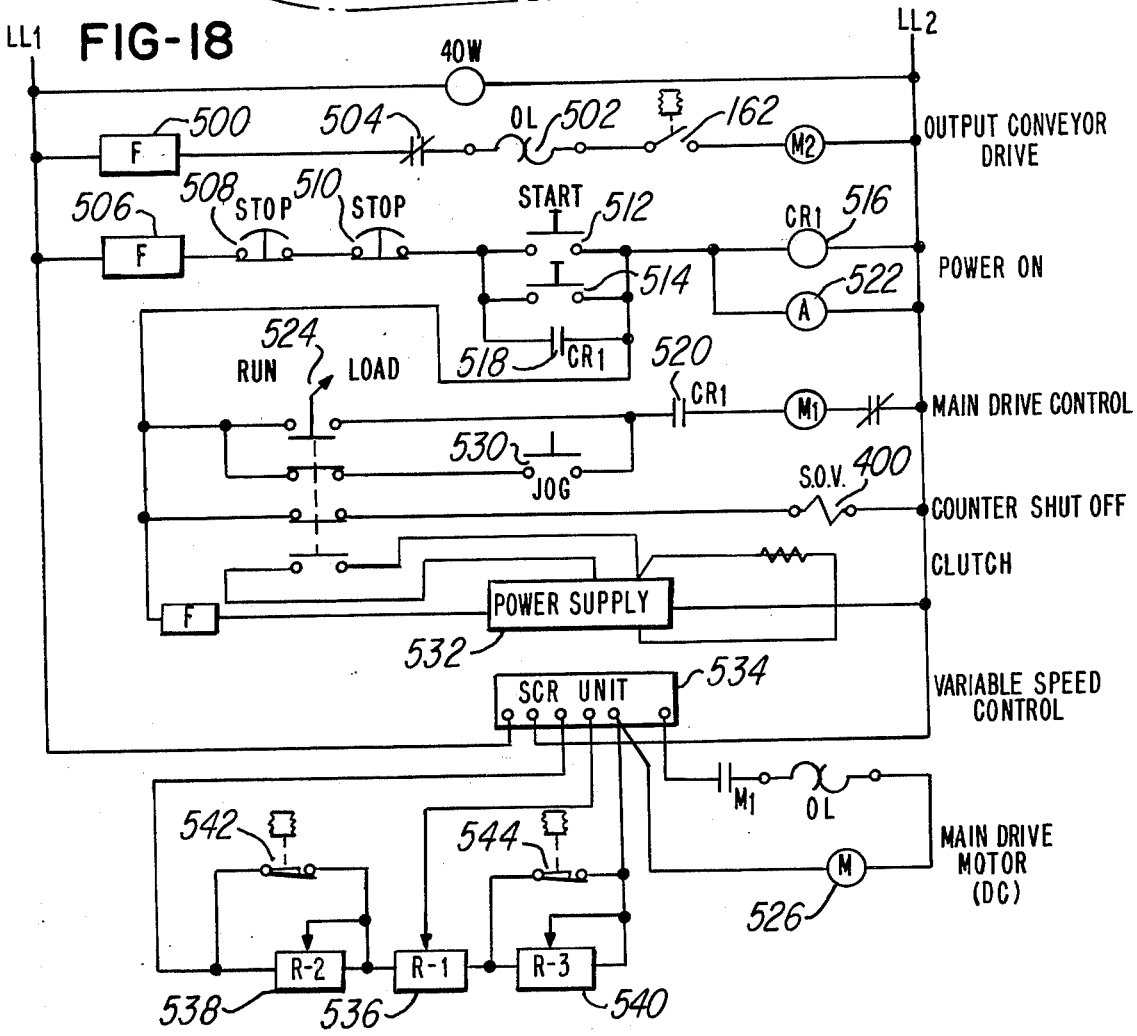
FIG. 18 is a schematic view of the electrical circuitry of the device.

In FIG. 18 M2 designates the electrical motor which drives the output conveyor Y, and M1 designates the main drive motor which runs the rest of the machine.

A 40-watt light bulb is connected across lines LL1 and LL2 to prevent the accumulation of moisture within the electrical box N.

Fuse 500 protects the output conveyor motor M2, overloading of which is prevented by overload device 502, OL. If the motor tends to overload, overload device 502 will open contact 504 disconnecting power to the motor M2. The motor itself is normally turned on and off by limit switch 162 which, as earlier noted, is a pressure swith which is pressurized through the pneumatic system each time a stack of articles is deposited onto the output conveyor Y.

Fuse 506 protects the control circuit for power-on via the two normally closed stop buttons 508–510, through the two momentary start buttons 512–514 to energize 516, the coil CR1 of the power-on circuit. When coil 516 is energized it closes the contacts CR 1 of 518 which are connected directly across the start buttons 512 and 514, and it also closes the one set of contacts 520 of CR 1 in the main drive control circuit. When the start buttons 512 and 514 are pushed, the CR 1 contacts 518 are closed and CR 1 (516) is kept energized. When CR 1 (516) is energized an indicator light 522 at A is illuminated.

The run-load switch 524 allows some portions of the machine to run while other portions of the machine are stopped. That is, main drive motor 526 (M1) operates the paper rollers 54-56, 58-60, 66-68 and 70-72; the spiked chain 82; the conveyors 26, 28, 32, and 34; and the ram 90. A clutch 528 controlled by switch 524 is provided for enabling the conveyors to be stopped while permitting the aforesaid rollers, spiked chains 82, and ram 90 to operate during those periods of time when the carrier-member-forming webs of rolls F are depleted while a new supply of carrier-member material is threaded upwardly between the four sets of rolls illustrated in FIG. 3.

The jog switch 530 is provided to jog the aforesaid rolls to the point where the knife roll 58 is open and the carrier-member-forming material can be moved up between them when a new roll F is utilized. The run-load switch 524 is a manually operated selector switch on the control panel N. The solenoid valve 400 of the pneumatic system when closed, stops the transmission of pressure to counter E as shown on the pneumatic system diagram, thereby discontinuing the transmission of ram-induced impulses via valve 404 to the counter.

Power to the DC clutch 532 is controlled by the run-load switch 524.

The SCR unit 534 (silicon controlled rectifier) is a speed control unit for the main drive motor 526 (M1) of the machine. Said motor can be driven at speeds of from 0 rpm to full speed by simply varying the main speed control rheostat 536 on control panel N.

In FIGS. 1 and 2 the numerals 546 and 548 designate product sensors which span conveyor 28 and which have drag arms 547 and 549 which contact the articles being conveyed, said sensors operate pressure switches 542 and 544 respectively, of FIG. 18, which in turn control rheostats 538 and 540 which control the speed of motor 526 of the conveyors 32 and 34 of the accumulator station D.

If and when the rate of delivery of the articles to the accumulator station D is too slow, sensor 548 actuates pressure switch 544 which controls rheostat 540 to slow the speed of motor 526 (M1).

If and when the rate of delivery of the articles on conveyor 28 to the accumulator station D is too fast, sensor 546 activates pressure switch 542 which controls rheostat 538 to speed up motor 526.

What is claimed is:

1. A device for sequentially accumulating in vertically stacked relationship and thereafter releasing the entire stack of a predetermined number of groups of individual flat articles, comprising:

means accumulating and advancing a plurality of flat, similar articles in end-to-end coplanar abutting relationship;

means successively subdividing a predetermined number of the foremost of said articles into individual groups;

means advancing the articles of each individual group onto a movable carrier means for and which is unique to each individual group of articles;

a vertically movable support means including a pair of complementary carrier member receptive platforms each of which are selectively movable from fully extended fully elevated positions to fully extended fully lowered positions, and thence from fully extended fully lowered positions to fully retracted fully lowered positions, and thence to fully retracted fully elevated positions in coplanar relationship with the other of said platforms when at a fully extended fully elevated position;

means advancing said carrier means and the group of articles thereon to a position above and in vertical alignment with a fully extended platform of the vertically movable support means;

means lowering each carrier means and the group of articles thereon onto a platform of said support means and the preceding groups of articles deposited thereon until a predetermined number of individual groups of articles have been stacked upon said support means; and means for removing, as a unit, the entire stack of groups of articles from said support means, while depositing said stack onto an output conveyor.

2. A device as called for in claim 1 which includes a first conveyor upon which a plurality of individual, similar, flat articles are initially deposited on opposite sides of an elevated divider member for advancing said articles in end-to-end abutting relationship and in single file in each of two rows, and a second conveyor on which articles from the first conveyor are deposited and advanced at a slower rate toward the means which subdivide the articles into individual groups, wherein each group comprises a predetermined number of pairs of articles arranged in side-by-side relationship and with the articles of each row in end-to-end contact.

3. A device as called for in claim 2 wherein the means for successively subdividing the articles into individual groups includes a third conveyor which is located above and mounted for movement toward and from the conveying surface of the second conveyor for alternately engaging the upper surfaces of articles on the second conveyor to maintain them against and in driven relationship therewith, and out of engagement with said upper surfaces for permitting the second conveyor to move relative to the articles supported thereon.

4. A device as called for in claim 3 wherein the means for subdividing predetermined numbers of pairs of articles on the second conveyor into individual groups, includes means which are alternately movable into and out of interferring relationship with the foremost of the articles of each succeeding group of articles supported on the second conveyor.

5. A device as called for in claim 4 wherein the alternately movable means comprise a pair of gates each of which are pivotally mounted for alternate movement into and out of interferring relationship with the first of the articles of the next group to be advanced onto the carrier means.

6. A device as called for in claim 5 wherein alternate movement of the gates is synchronized with respect to the alternate movement of the said third conveyor, whereby said gates are in interferring position whenever the third conveyor is out of engagement with the articles on the second conveyor, and in interferring position whenever the third conveyor is in engagement with the articles on the said second conveyor.

7. A device as called for in claim 2 wherein the means for advancing the articles of each individual group onto a movable carrier means, includes means for advancing a sheet of flexible material upwardly toward the discharge end of the second conveyor in timed relationship with the rate of advancement of a group of articles from said conveyor, and other means for maintaining said sheet in a taut, group of articles supporting relationship while advancing said sheet in the horizontal plane of and away from the second conveyor.

8. A device as called for in claim 7 wherein the means for maintaining said sheet in taut relationship while moving it from the second conveyor, includes a pair of elongate endless conveyor chains located one on each side of the sheet when in a horizontal plane, said chains including outwardly projecting sheet piercing elements the free outer ends of which are received within an elongate groove in each of a pair of elongate members disposed along opposite sides of the sheet during those periods of time when opposite sides of the sheet are impaled on said piercing elements between said chains and their corresponding grooves, while the sheet is advanced to a position above and in vertical alignment with the said vertically movable support means.

9. A device as called for in claim 1 wherein the lowering means sequentially lowers each carrier member and the group of articles thereon onto a fully extended platform, and the lowering means comprises a ram which is mounted for vertical movement between elevated and lowered positions, said ram being disposed in an elevated position during those periods of time when a carrier member is being advanced to a position above and in vertical alignment with the said vertically movable support means, and means moving said ram from elevated to a lowered position for sequentially releasing the said carrier member from its position above and in vertical alignment with a fully extended platform and depositing it on said platform.

10. A device as called for in claim 9 which includes means for counting the number of carrier members which are deposited on a fully extended platform as said platform is lowered in a step-by-step manner from its fully raised position each time another carrier member is deposited on it, until a predetermined number of carrier members have been accumulated in vertically stacked relationship on said platform at which time means are actuated for simultaneously moving the other platform from its fully elevated retracted position to a fully elevated extended position to receive the next carrier member deposited by the ram while lowering the loaded platform to a fully extended fully lowered position for depositing the entire group of stacked articles onto the output conveyor after which the fully lowered, unloaded platform is fully retracted and then elevated while retracted to a fully elevated position.

11. A device as called for in claim 10 wherein the lower surface of each of the platforms is defined by a plurality of laterally spaced, transversely extending, downwardly projecting, elongate ribs.

12. A device as called for in claim 11 wherein the surface of the output conveyor on which each stack of a group of articles is deposited is defined by a plurality of laterally spaced, transversely extending ribs each of which terminate in an elongate outer edge spaced from an endless conveyor-defining member from which they project, said ribs defining a plurality of laterally spaced open ended pockets which extend transversely of the conveyor, wherein the width of each pocket is dimensioned to loosely receive an adjacent pair of the ribs of a platform when in an extended, fully lowered position, and wherein the height of the platform ribs is less than the height of the conveyor ribs whereby the load on a platform is transferred to and deposited on the ribs of the output conveyor after which the platform is moved to a fully retracted lowered position.

13. A device as called for in claim 12 which includes means for advancing the output conveyor each time a platform has been lowered onto and then retracted from it, whereby the conveyor is advanced by an amount which exceeds the overall length of the product deposited thereon by a platform, and wherein advancement of the conveyor is stopped to receive a load from the next platform with the ribs of the platform and conveyor in cooperative, indexed relationship.

14. A device as called for in claim 2 which includes means in advance of the said first conveyor for sequentially depositing a plurality of individual, similar, flat articles onto said conveyor.

15. A device as called for in claim 14 wherein said means includes means for supporting at least one elongate member from which each of a plurality of articles is sequentially severed relative to the cutting zone of a knife which sequentially severs articles of similar thickness from the lower end of said elongate member, and wherein said severed articles are deposited one-at-a-time in coplanar relationship on said conveyor.

16. A device as called for in claim 2 which includes means for selectively varying the rate of advancement of the first conveyor relative to the rate of advancement of the second conveyor for controlling the rate at which articles on the first conveyor are delivered to the second conveyor.

17. A device as called for in claim 16 wherein the said means comprises a pair of article-actuated sensors, one of which is responsive to speed up and the other of which is responsive to slow down the rate of advancement of the first conveyor.

18. A device as called for in claim 2 wherein means are provided for enabling the means for advancing the said carrier means to be selectively operated independently of but by the same motor by which the first and second conveyors and the means for subdividing the articles into individual groups are driven.

19. A device for sequentially accumulating in vertically stacked relationship and thereafter releasing the entire stack of a predetermined number of groups of individual flat articles, comprising:

means accumulating and advancing a plurality of flat, similar articles in end-to-end coplanar abutting relationship;

a subdividing conveyor located above a portion of the advancing means for alternately engaging the upper surfaces of the advanced articles to maintain them against and in driven relationship with the portion of the advancing means subjacent thereto, and disengaging the upper surface of said articles for permitting relative movement between the articles and the advancing means, said subdividing conveyor being operative to subdivide a predetermined number of the foremost of said articles into individual groups;

means advancing the articles of each individual group onto a movable carrier means for and which is unique to each individual group of articles;

means advancing said carrier means and the group of articles thereon to a position above and in vertical alignment with a vertically movable support means;

means lowering each carrier means and the group of articles thereon onto said support means and the preceding groups of articles deposited thereon until a predetermined number of individual groups of articles have been stacked upon said support means; and means for removing, as a unit, the entire stack of groups of articles from said support means, while depositing said stack onto an output conveyor.

* * * * *